US006139398A

United States Patent [19]

DeAngelis

[11] Patent Number: 6,139,398

[45] Date of Patent: Oct. 31, 2000

[54] SYSTEM FOR, AND METHOD OF, MINIMIZING THE CONSUMPTION OF BATTERY ENERGY IN A TOY VEHICLE

[76] Inventor: Peter C. DeAngelis, 2430 Torrejon Pl., Carlsbad, Calif. 92009

[21] Appl. No.: 09/018,060

[22] Filed: Feb. 3, 1998

[51] Int. Cl.[7] ..... A63H 30/04

[52] U.S. Cl. ..... 446/456; 463/58

[58] Field of Search ..... 446/456, 408, 446/454, 455, 444, 443, 431, 457, 462; 463/58, 62, 63

[56] References Cited

U.S. PATENT DOCUMENTS

| | | | |
|---|---|---|---|
| 4,275,394 | 6/1981 | Mabuchi et al. | 446/456 X |
| 4,938,483 | 7/1990 | Yavetz | 446/456 X |
| 5,088,955 | 2/1992 | Ishimoto | 446/456 X |
| 5,209,695 | 5/1993 | Rothschild | 446/456 X |
| 5,216,337 | 6/1993 | Orton et al. | 446/456 X |
| 5,376,038 | 12/1994 | Arad et al. | 446/408 X |
| 5,452,901 | 9/1995 | Nakada et al. | 446/456 X |
| 5,727,985 | 3/1998 | George et al. | 446/456 X |

*Primary Examiner*—D. Neal Muir
*Attorney, Agent, or Firm*—Fulwider Patton, et al.; Ellsworth R. Roston

[57] ABSTRACT

A member (e.g. toy vehicle) is powered at first times and depowered at second times. The member includes a plurality of switches having first and second terminals defining open and closed states, the switches being normally open and actuatable to the closed state in a pattern defining the member's address. A vehicle battery provides an energizing voltage to the first terminals of the address switches. A vehicle microprocessor is operative in the vehicle depowered state with at least one of the address switches closed to open an additional switch, thereby preventing the battery voltage from being applied to the address switches in the vehicle. The microprocessor is operative, with the vehicle powered and with at least one of the address switches closed, to close the additional switch thereby providing for the introduction of the battery voltage to the addressing circuit for the vehicle and for the vehicle operation. Each address switch may form a circuit branch with an impedance (e.g. resistor) to provide for a voltage drop across the impedance when the address switch is closed. In this way, the circuit branches consume no power when the vehicle is depowered even though individual ones of the address switches are closed, and a voltage pattern indicative of the vehicle address is produced in the circuit branches when the vehicle is powered. Another embodiment of the invention eliminates the additional switch. In this embodiment, the address switches are powered by the microprocessor at the times that the microprocessor determines that voltages should be applied to the address switches.

52 Claims, 3 Drawing Sheets

SYSTEM FOR, AND METHOD OF, MINIMIZING THE CONSUMPTION OF BATTERY ENERGY IN A TOY VEHICLE

This invention relates to systems for conserving power in members (such as toy vehicles) operable by a battery.

BACKGROUND OF THE INVENTION

Children's toys such as vehicles are often energized by batteries. A master switch is generally provided in each such toy vehicle to control the operation of the vehicle. When the master switch in the vehicle is open, no power is consumed in the vehicle. When the master switch in the vehicle is closed, power is consumed in the vehicle.

Often a child will close the master switch, play with the vehicle for a short while and then walk away from the vehicle while the vehicle is still powered by the batteries. Power then continues to be drained from the vehicle even though the child is not operating the vehicle. As a result, the batteries in the vehicle have a relatively short life. This requires the child's parents to purchase other batteries and to insert such other batteries into the vehicle in place of the dead batteries. As children's parents will appreciate, batteries are relatively expensive.

BRIEF DESCRIPTION OF THE INVENTION

This invention provides a system for conserving the power in batteries in a child's toy such as a toy vehicle when the vehicle is addressed by a particular pattern of closed address switches. In one embodiment of the invention, a member (e.g. toy vehicle) is powered at first particular times and depowered at second particular times. The member includes a plurality of switches having open and closed states and being normally open and actuatable to the closed state in an individual pattern defining the member's address.

A battery in the vehicle provides an energizing voltage to the first terminals of the address switches. A microprocessor in the vehicle is operative in the vehicle depowered state, with at least one of the address switches closed, to open an additional switch thereby preventing the battery voltage from being applied to the address switches in the vehicle. The microprocessor is operative, with the vehicle powered and with at least one of the address switches closed, to close the additional switch, thereby providing for the introduction of the battery voltage to the vehicle and for the vehicle operation.

Each address switch may form a circuit branch with an impedance (e.g. resistor) to provide for a voltage drop across the impedance when the address switch is closed and the additional switch is closed. In this way, the circuit branches consume no power when the vehicle is depowered even though individual ones of the address switches are closed, and a voltage pattern indicative of the vehicle address of the toy vehicle is produced in the circuit branches when the vehicle is powered.

Another embodiment of the invention eliminates the additional switch. In this embodiment, the address switches are powered by the microprocessor at the times that the microprocessor determines that voltages should be applied to the address switches.

DETAILED DESCRIPTION OF THE INVENTION

Figure 1:
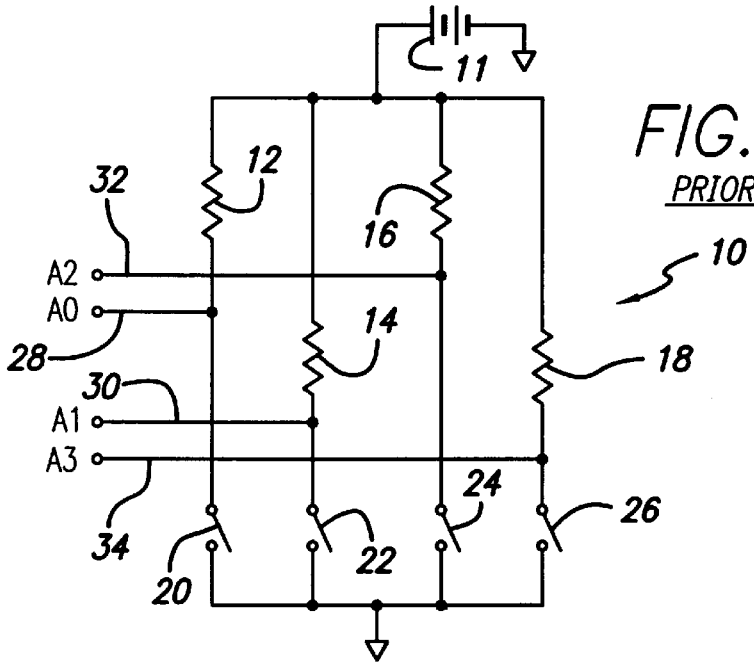
FIG. 1 PRIOR ART
FIG. 1 is a diagram of an electrical circuit of the prior art for addressing a vehicle.
Figure 3:
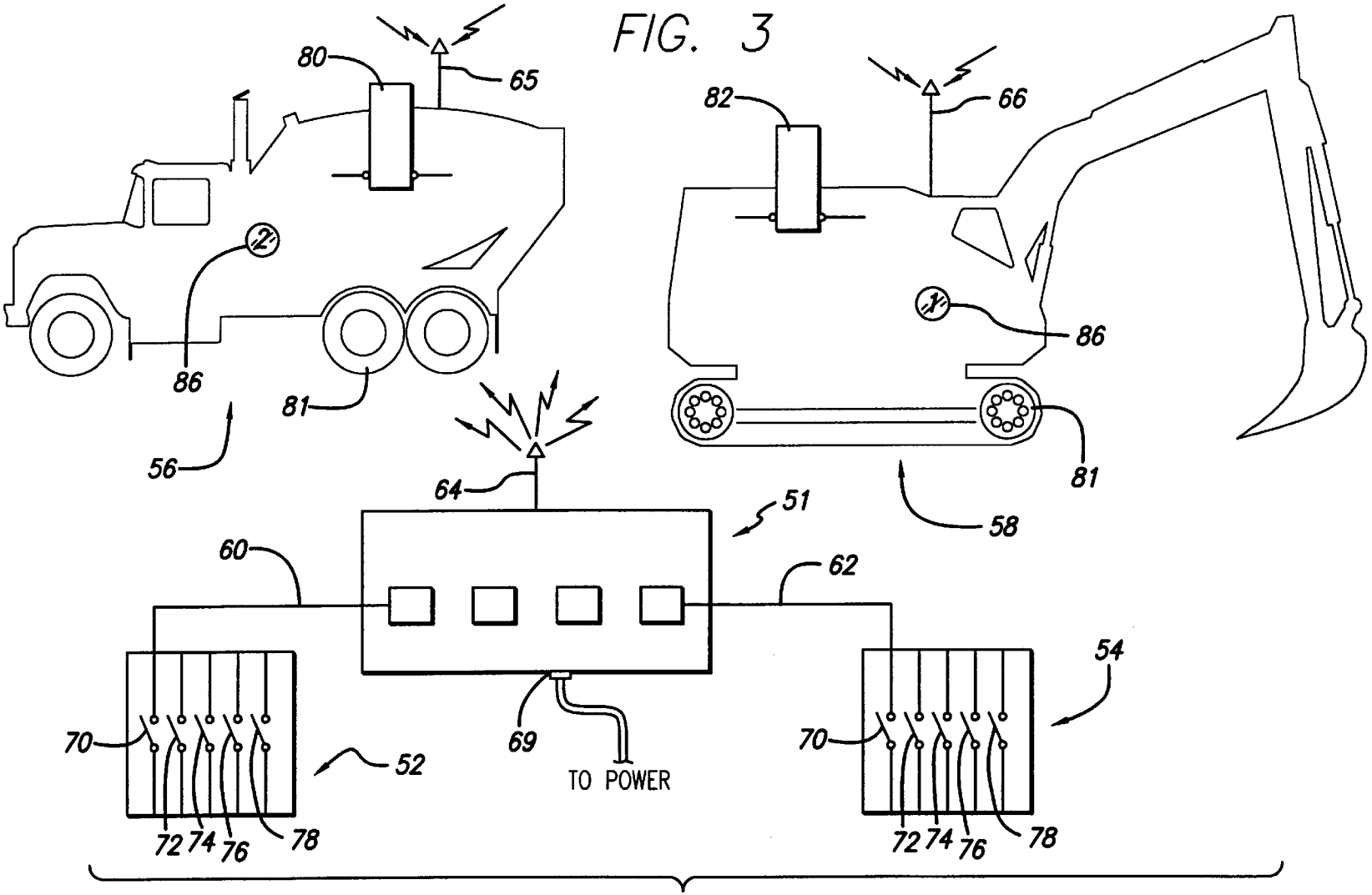
FIG. 3 is a schematic representation of a system in which the circuit of FIG. 2 can be included to provide an operation of a toy vehicle included in the system.

FIG. 1 shows a system, generally indicated at 10, of the prior art for providing an address in a vehicle such as generally indicated at 56 and 58 in FIG. 3. The system 10 includes a battery 11 for providing an energizing voltage at a first terminal of the battery and a voltage such as ground at a second terminal of the battery. The first terminal of the battery 10 is connected to first terminals of impedances (e.g. resistors) 12, 14, 16 and 18. The impedances 12, 14, 16 and 18 are connected to the movable contacts of switches 20, 22, 24 and 26. The stationary contacts of the switches 20, 22, 24 and 26 are connected to the reference potential such as ground. Each of the impedances 12, 14, 16 and 18 defines a circuit branch with the associated one of the switches 20, 22, 24 and 26.

Lines 28, 30, 32 and 34 are respectively connected to the movable contacts of the switches 20, 22, 24 and 26. The lines 28, 30, 32 and 34 (also respectively designated as A0–A3 in FIG. 1) may constitute address lines which provide a pattern of signals dependent upon the individual closures of the switches 20, 22, 24 and 26. Since four (4) switches are schematically shown in FIG. 1, sixteen (16) different combinations of switch closures can be provided. Each of these 16 different combinations of switch closures can provide an address on the lines 28, 30, 32 and 34 for an individual one of sixteen (16) different toy vehicles, two (2) of them being shown at 56 and 58 in FIG. 3.

Current flows through the impedance and the switch in a circuit branch when the switch in the circuit branch is closed. For example, current flows through the impedance 14 and the switch 22 when the switch 22 is closed. This causes a voltage drop to be produced across the impedance 14 and a low voltage to be produced on the line 30. It also causes the power in the battery 11 to be drained as a result of the flow of current through the impedance (e.g. the impedance 14) and the switch (e.g. the switch 22). This limits the life of the battery 11 even though no child is playing with the vehicle in which the circuit shown in FIG. 1 is disposed. In the circuit shown in FIG. 1, even though no child is playing with the vehicle in which the address circuit shown in FIG. 1 is disposed, no provision is made for preventing current from flowing through a circuit branch providing an address for the vehicle when the switch in the circuit branch is closed.

Figure 2:
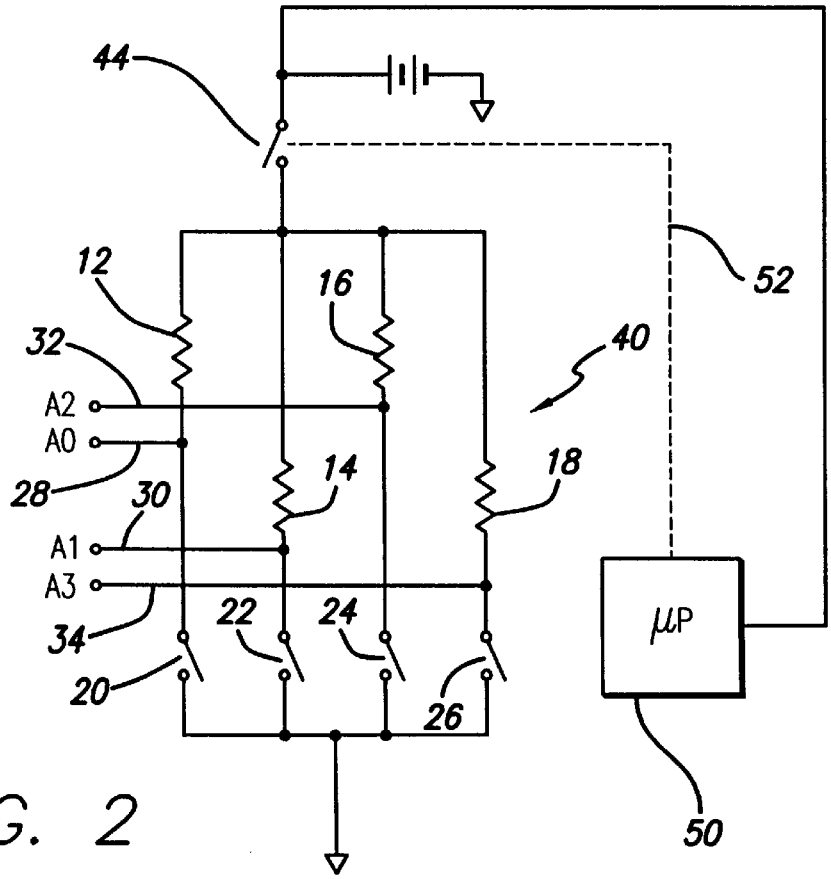
FIG. 2 is a diagram of an electrical circuit constituting one embodiment of this invention for addressing the vehicle.

FIG. 2 is a circuit diagram of a system constituting one embodiment of the invention for inclusion in a toy vehicle such as one of the toy vehicles 56 and 58 in FIG. 3. This system is generally indicated at 40. The embodiment 40 includes the battery 11, the impedances 12, 14, 16 and 18, the switches 20, 22, 24 and 26 and the lines 28, 30, 32 and 34. However, a switch 44 is connected between the position terminal of the battery 11 and the impedeness 12, 14, 16 and 18. The closure of the switch 44 is controlled by a microprocessor 50 which receives energy from the battery 11. This is indicated by broken lines 52 extending between the microprocessor 50 and the movable arm of the switch 44.

Although the switch 44 is shown as a mechanical switch, it will be appreciated that it may be another type of switch such as a transistor switch.

When the vehicle is to be powered, the microprocessor 50 produces an operation of the switch 44 so that the switch 44 is closed. This causes current to flow through the circuit branches in which the switches are closed, thereby producing an address on the lines 28, 30, 32 and 34. For example, when the switches 22 and 26 are closed, an address represented by high voltages on the lines 28 and 32 and by low voltages on the lines 30 and 34 is produced to provide an address for the toy vehicle.

When the vehicle becomes depowered, the microprocessor 50 operates the switch 44 so that the switch becomes opened. The opening of the switch 44 prevents a voltage from being applied to the address switches 20, 22, 24 and 26. This prevents the vehicle from being addressed and operated. As will be seen from the subsequent discussion, the microprocessor 50 operates only at selective times to close the switch 44, thereby powering the vehicle. The selective times occur only at the times that a child is interested in operating the vehicle and at the times that selective ones of the address switches 20, 22, 24 and 26 are closed to provide an address for the vehicle. At all other times, the microprocessor 50 operates to open the switch 44.

The system 40 shown in FIG. 2 and described above is adapted to be used in a system disclosed and claimed in co-application 08/763,678 filed by William M. Barton, Jr., Paul Eichen and Peter C. DeAngelis on Dec. 11, 1996, for "System For, and Method of, Selectively Providing the Operation of Toy Vehicles" and assigned of record to the assignee of record of this application. The system disclosed in co-application 08/763,678 is shown on a simplified basis in FIG. 3 and this simplified basis is described below. Reference should be made to co-pending application 08/763,678 to complete the disclosure in this application with respect to the showing in FIG. 3 if it is believed that details necessary or desirable to complete the disclosure in this application with respect to FIG. 3 are missing from FIG. 3 of this application.

The system shown in FIG. 3 includes a central station generally indicated on a simplified basis at 51, a pair of hand-held pads generally indicated on a simplified basis respectively at 52 and 54 and a pair of vehicles generally indicated on a simplified basis respectively at 56 and 58. The central station 51 communicates with the pads 52 and 54 by wires 60 and 62 respectively connected between the central station and the pads. The central station 51 has an antenna 64 which transmits signals to antenna 65 and 66 respectively on the vehicles 56 and 58. The central station has a plug 69 which is disposed in a wall socket to apply a voltage to the central station and the pads 52 and 54.

The central station 51 interrogates the pads 52 and 54 on a cyclic basis to determine if each of the pads has addressed one of vehicles 56 and 58. Each of the pads 52 and 54 has a switch 70 which is manually activated. A single actuation of the switch 70 on one of the pads 52 and 54 causes the vehicle 56 to be addressed by that pad. Two actuations of the switch 70 on one of the pads within a particular period of time causes the vehicle 58 to be addressed by that pad. For example, a user may actuate the switch 70 in the pad 52 twice within the particular period of time to address the vehicle 58 for operation by that pad. When the user of the pad 52 addresses the vehicle 58, the user of the pad 52 continues to operate the vehicle until such time as the user of the pad no longer desires to operate the vehicle. The user of the pad 52 also operates a plurality of switches such as switches 72, 74, 76 and 78 on the pad 52 to control the movements of the addressed vehicle 58.

The vehicles 56 and 58 are provided with sockets to receive a key such as respectively indicated at 80 and 82 in the vehicles 56 and 58. Each of the keys 80 and 82 is constructed to close the switches 20, 22, 24 and 26 in the vehicles 56 and 58 in an individual pattern representative of an individual address for the vehicle receiving the key. For example, when the key 80 is inserted into a socket in one of the vehicles 56 and 58, it may close the switches 20 and 24 in that vehicle. Similarly, when the key 82 is inserted into the socket in one of the vehicles 56 and 58, it may close the switches 22 and 26 in that vehicle.

Each of the vehicles 56 and 58 has wheels 81. The left wheels in the vehicle are rotated in one direction when the switch 72 in the pad controlling the operation of the vehicle is closed. The left wheels on the vehicle are rotated in the opposite direction when the switch 74 in the pad is closed. The right wheels in the vehicle are rotated in one direction when the switch 76 in the pad controlling the operation of the vehicle is closed. The right wheels are rotated in the opposite direction when the switch 78 in the pad controlling the operation of the vehicle is closed. In this way, by closing different pairs of the switches 72, 74, 76 and 78, the vehicle can be moved forwardly or rearwardly, can be spin-turned in opposite directions and can be turned in opposite directions while moving forwardly or rearwardly.

Each of the vehicles 56 and 58 has a light 86 which is disposed on the key and which is illuminated when one of the keys 80 and 82 is inserted into the vehicle. For example, the vehicle 58 may be illuminated by the light 86 to indicate the numeral "1" upon the insertion of the key 82 into the socket in the vehicle and to indicate the number "2" upon the insertion of the key 80 into the socket in the other vehicle 56. This numerical indication indicates to the users of the pads 52 and 54 the number of times that the switch 70 has been actuated within the particular period of time to select the desired vehicle.

The selection of the vehicle 58 by the pad 52 is transmitted to the central station 51 through the wires 60. The central station 51 then produces packets of signals. First signals in the packets indicate the address of the vehicle 58. As previously indicated, the address of the vehicle 58 is dependent upon the insertion of one of the keys 80 and 82 into the socket in the vehicle 58. For example, the switches 20 and 24 are closed, and the switches 22 and 26 remain open, when the key 82 is inserted into the socket in the vehicle 58. Second signals in the packets indicate the operation of the switches 72, 74, 76 and 78 controlling the movement of the vehicle 58.

The packets of signals controlling the operation of the vehicle 58 are transmitted by the antenna 64 in the central station 51 to the antenna 66 in the vehicle. The vehicle 58 accepts these packets of signals from the central station 51 because the address of the first signals in these packets corresponds to the address represented by the closed state of the switches 20 and 24, and the open state of the switches 22 and 26, in the vehicle. The vehicle 58 is then moved in accordance with the instructions in the second signals in the signal packets addressed to the vehicle 58.

When the vehicle 58 is addressed by the pad 52, the microprocessor 50 in the vehicle causes the vehicle to be in a powered and active state. In this state, the switch 44 in FIG. 2 is closed. The vehicle continues to be operated by the pad 52 as long as the pad continues to provide to the central station 51 signals indicating that the pad is operating the vehicle. However, if the pad 52 fails to provide such signals to the central station 51 for a first particular period of time (e.g. one minute) as determined by the microprocessor 50, the vehicle 58 becomes operative by the microprocessor 50 in the powered but inactive state. In this state, the vehicle 58 can be selected either by the pad 52 or the pad 54. In both the powered and active state and the powered but inactive state, the switch 44 is closed. The closure of the switch 44 causes the voltage from the battery 11 to power the address circuit in the vehicle.

If neither the pad 52 nor the pad 54 addresses the vehicle 58 for a second particular period of time, as determined by the microprocessor 50, after the vehicle has become powered but inactive by the microprocessor, the microprocessor causes the vehicle 58 to become depowered. In the depowered state, the microprocessor 50 causes the switch 44 to be opened. This prevents any power from being dissipated in the address circuit shown in FIG. 2 even though the switches 20 and 24 may remain closed. This eliminates power losses resulting in the battery 11 in the prior art from the continued energizing of the address circuit in the vehicle and provides for a long life in the battery 11 in the vehicle 58 even though the child may forget to remove the key 82 from the vehicle 58 after the child has stopped playing with the system including the central station, the pads and the vehicles.

Figure 4:
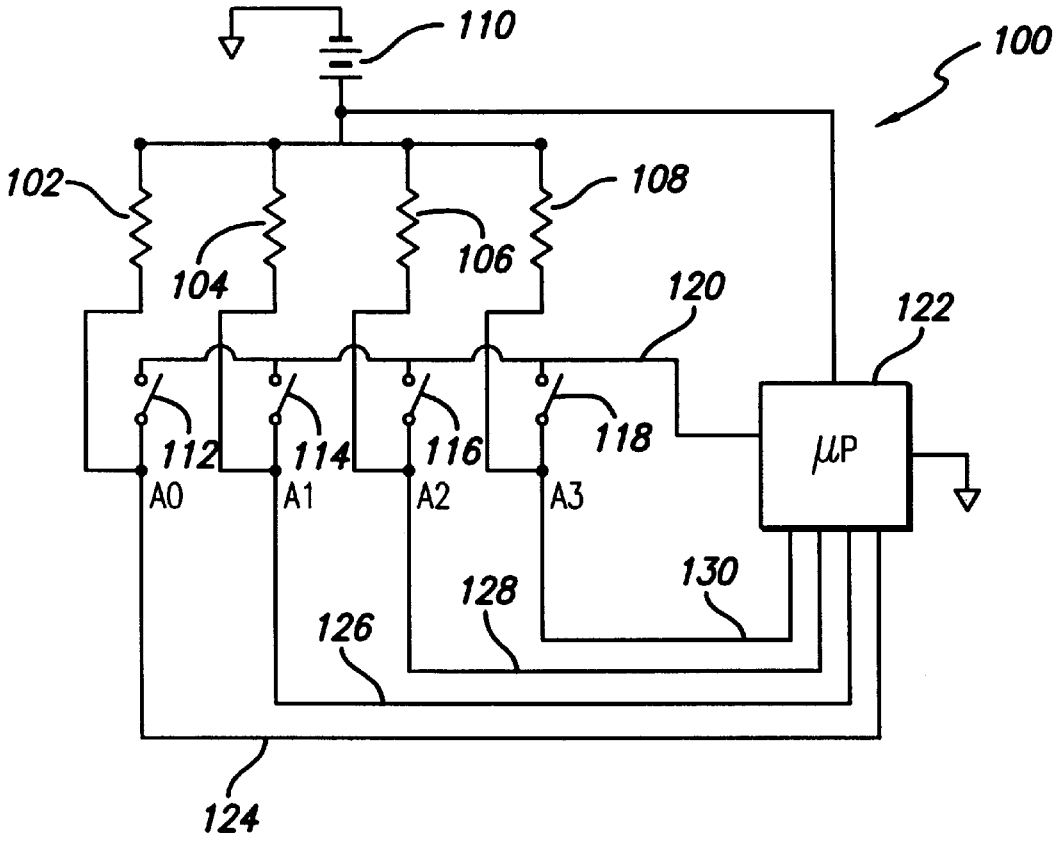
FIG. 4 is a diagram of an electrical circuit constituting another embodiment of this invention for addressing the vehicle.

FIG. 4 illustrates an addressing circuit, generally indicated at 100, constituting a preferred embodiment of the invention. This addressing circuit is advantageous because it eliminates the switch 44 shown in FIG. 2. The addressing circuit includes a plurality of resistors 102, 104, 106 and 108 each disposed in a separate circuit branch. One terminal of each of the resistors 102, 104, 106 and 108 is connected to the ungrounded terminal of a battery 110. The other terminals of the resistors 102, 104, 106 and 108 are respectfully connected to the movable contacts of address switches 112, 114, 116 and 118.

A line 120 from a microprocessor 122 is common with the stationary contacts of the address switches 112, 114, 116 and 118. Lines 124, 126, 128 and 130 respectively extend from the movable contacts of the address switches 112, 114, 116 and 118 to the microprocessor 122. The lines 124, 126, 128 and 130 may be respectively considered as the address lines A0, A1, A2 and A3 (corresponding to the address lines A0, A1, A2 and A3 in FIG. 2).

When the vehicle such as one of the vehicles 56 and 58 is depowered, a positive voltage is provided on the line 120. This prevents current from flowing through the resistors 102, 104, 106 and 108 regardless of whether or not any of the address switches 112, 114, 116 and 118 is closed. When the vehicle is in the powered and active state or in the powered but inactive state, a low voltage is applied to the output line 120 from the microprocessor 122. This causes a low voltage to be applied to the individual one of the address lines 124, 126, 128 and 130 in which the address switches are closed. For example, when the switches 114 and 118 are closed and a low voltage is applied to the output line 120, low voltages are produced at the address lines 126 (Al) and 130 (A3). However, high voltages are produced at such times on the address lines 124 and 128 because of the respective connections of the resistors 102 and 106 to such lines. 7

Applicants have used the word "vehicle" in the specification and claims in this application in a broad sense consistent with the definition of the word "vehicle" in various dictionaries. For example, Webster's New Collegiate Dictionary copyrighted in 1976 defines "vehicle" as a "means of carrying or transporting something" and also as "an agent of transmission". Webster's Third New International Dictionary copyrighted in 1993 also defines a "vehicle" as "a means of carrying or transporting something" and additionally defines "vehicle" as "a container in which something is conveyed" and as "a carrier of goods and passengers".

Although this invention has been disclosed and illustrated with reference to particular embodiments, the principles involved are susceptible for use in numerous other embodiments which will be apparent to persons of ordinary skill in the art. The invention is therefore, to be limited only as indicated by the scope of the appended claims.

What is claimed is:

1. In combination for use in a vehicle having a powered and active state, a powered but inactive state and a depowered state, a plurality of circuit branches, a plurality of address switches each having first and second states, each of the address switches being disposed in an individual one of the circuit branches, a battery connected to provide currents through the circuit branches, a microprocessor for determining when the vehicle is in the powered and active state, in the powered but inactive state and in the depowered state, and means associated with the microprocessor and operatively coupled to the battery and to the circuit branches for providing for a passage of currents through the circuit branches with the address switches in the first state when the vehicle is in the powered and active state and in the powered but inactive state and for preventing the flow of currents through the circuit branches, including the circuit branches with the address switches in the first state, when the vehicle is in the depowered state.

2. A combination as set forth in claim 1, including, the vehicle having an address, the address switches being disposed in the circuit branches in the second state and being actuatable to the first state in a pattern representing the address of the vehicle.

3. A combination as set forth in claim 1, including, a plurality of impedances each disposed in an individual one of the circuit branches for receiving the flow of current through the individual one of the circuit branches when the address switch in the individual one of the circuit branches is in the first state and the vehicle is in one of the powered and active state and the powered but inactive state.

4. A combination as set forth in claim 3 wherein each of the impedances is connected in an individual one of the circuit branches with an individual one of the address switches and wherein a plurality of terminals are provided each common in an individual one of the circuit branches with the address switch in that circuit branch and wherein a plurality of lines are provided each connected to the address switch and the impedance in an individual one of the circuit branches.

5. A combination as set forth in claim 3 wherein the impedances are resistors.

6. A combination as set forth in claim 4 wherein the impedances are resistors.

7. In a combination as set forth in claim 1, an additional switch connected to the address switches and having first and second states of operation and operable in the first state to provide for the flow of current through the address switches in the first state of the address switches and operable in the second state to prevent the flow of current through the address switches, the additional switch being coupled to the microprocessor for operation in the first state in the powered and active state of the vehicle and in the powered but inactive state of the vehicle and for operation in the second state in the depowered state of the vehicle.

8. In a combination as set forth in claim 1, the microprocessor being operatively coupled to the address switches (a) to apply a first voltage to the address switches in the powered and active state, and in the powered but inactive state, of the vehicle to provide for the flow of current through the address switches operative in the first state and (b) to prevent the flow of the current through the address switches, including the address switches in the first state, in the depowered state of the vehicle.

9. In combination, a vehicle having powered and depowered states, a battery in the vehicle, a plurality of address switches in the vehicle, each of the address switches having first and second states of operation, a plurality of circuit branches in the vehicle, each of the circuit branches including an individual one of the address switches, and a microprocessor disposed in the vehicle and operable to provide the powered state of the vehicle at first times and the depowered state of the vehicle at second times different from the first times, and means disposed in the vehicle and operable in association with the battery and the microprocessor in the powered state of the vehicle to provide for a passage of currents through individual ones of the circuit branches having the address switches in the first state and operable in association with the battery and the circuit branches in the depowered state of the vehicle to prevent currents from flowing through the circuit branches including the individual ones of the circuit branches with the switches in the first state.

10. In a combination as set forth in claim 9 wherein means are disposed on the vehicle in removable relationship to the vehicle for providing the first state in individual ones of the address switches to provide an address for the vehicle.

11. In a combination as set forth in claim 9 wherein a plurality of impedances are provided and wherein the circuit branches have a common connection with the impedances and wherein lines extend in the circuit branches from the impedances to the address switches to provide an address for the vehicle, during the powered state of the vehicle, in accordance with the pattern of the address switches in the first state.

12. In a combination as set forth in claim 9, including, an element on the vehicle for receiving packets of signals providing an address corresponding to the address provided by the pattern of the address switches in the first state and providing commands for the operation of the vehicle, and means in the vehicle for operating the vehicle in the powered state of the vehicle in accordance with the commands provided by the signals in the packets of signals received by the element in the vehicle and addressed to the vehicle.

13. In a combination as set forth in claim 12, including, means disposed on the vehicle in removable relationship to the vehicle for providing the first state in individual ones of the address switches to provide the address for the vehicle.

14. In a combination as set forth in claim 12 wherein the vehicle is associated with a plurality of pads each operable to provide for the production of packets of signals addressed to the vehicle and wherein the vehicle has a powered and active state and a powered but inactive state and wherein the microprocessor provides for the energizing of the circuit branches in the powered and active state and in the powered but inactive state and wherein the microprocessor provides for the operation of the vehicle in the powered and active state during the reception by the vehicle of packets of signals from one of the pads with the address of the vehicle and wherein the vehicle operates in the powered but inactive state for a second period of time when the vehicle fails to receive, during a first period of time, packets of signals from the one of the pads with the address of the vehicle and wherein the vehicle is returned to the powered and active state when the vehicle receives packets of signals addressed to the vehicle from any one of the pads during the second period of time and wherein the vehicle operates in the depowered state after the second period of time when the vehicle fails to receive packets of signals addressed to the vehicle from any one of the pads during the second period of time.

15. In a combination as set forth in claim 9, an additional switch having first and second states and operable in the first state to provide for the flow of current through the individual ones of the circuit branches having the address switches in the first state and operable in the second state to prevent currents from flowing through the circuit branches including the individual ones of the circuit branches with the address switches in the first state, the microprocessor being associated with the additional switch to provide the additional switch in the first state with the vehicle in the powered state and to provide the additional switch in the second state with the vehicle in the depowered state.

16. In a combination as set forth in claim 9, the battery having an energizing voltage, the microprocessor being operative to provide a first voltage with the vehicle in the powered state and to provide a second voltage with the depowered state, the microprocessor being coupled to the address switches to provide the first and second voltages to the address switches, the first voltage having a magnitude relative to the energizing voltage in the battery to provide for the flow of currents through the individual ones of the circuit branches with the address switches in the first state of the address switches and the second voltage having a magnitude relative to the energizing voltage in the battery to prevent the flow of current through the circuit branches including the individual ones of the circuit branches with the address switches in the first state.

17. In a combination as set forth in claim 16, the microprocessor providing the second voltage on a first line in the depowered state of the vehicle and the first line being connected to the address switches to provide the second voltage on the address switches thereby preventing current from flowing through the address switches in the depowered state of the vehicle, the microprocessor providing, in the powered state of the vehicle, the first voltage on a plurality of lines each connected to an individual one of a plurality of terminals in the microprocessor to provide for the flow of current through the individual ones of the circuit branches with the address switches in the first state.

18. In combination for use in a vehicle having powered and depowered states, a battery, a plurality of address switches each having first and second states of operation, individual ones of the address switches being disposed in the first state to provide an individual address for the vehicle, first means operatively coupled to the battery and to the address switches for providing to the address switches a first voltage in the powered state of the vehicle to provide for a flow of current through the individual ones of the address switches having the first state of operation and for applying to the address switches a second voltage in the depowered state of the vehicle to prevent the flow of currents through the address switches including the address switches in the first state, and the first means being operative to provide for the operation of the vehicle at each instant in an individual one of the powered and depowered states.

19. In a combination as set forth in claim 18 wherein the first means includes a microprocessor operative to provide for the operation of the vehicle in an individual one of the powered and depowered states.

20. In a combination as set forth in claim 18 wherein the first means includes a microprocessor operable to provide for the application, in the powered state of the vehicle, of the first voltage to the address switches in the first state and operable, in the depowered state of the vehicle, to provide for the removal of the first voltage from the address switches in the first state.

21. In a combination as set forth in claim 18 wherein a microprocessor is connected to the address switches to apply the first voltage to the address switches in the powered state of the vehicle and to prevent the application of the first voltage to the address switches in the depowered state of the vehicle.

22. A combination as set forth in claim 18, including, the first means including a microprocessor, an additional switch having first and second states, the additional switch being connected to the address switches and being associated with the microprocessor for operation in the first state in the powered state of the vehicle and for operation in the second state in the depowered state of the vehicle, a plurality of impedances, and a plurality of circuit branches such including an individual one of the address switches and an individual one of the impedances to provide for a flow of current through the individual ones of the circuit branches with the address switches in the first state when the additional switch is in the first state.

23. In a combination as set forth in claim 19, including, a plurality of impedances, and a plurality of circuit branches such including an individual one of the address switches and an individual one of the impedances.

24. In combination, a vehicle having a powered state at first particular times and having a depowered state at second particular times different from the first particular times, a plurality of address switches in the vehicle, the address switches having first and second states of operation, a battery disposed in the vehicle and constructed to provide an energizing voltage, and means including a microprocessor disposed in the vehicle and responsive in the powered state of the vehicle to the energizing voltage from the battery for providing for an application of the energizing voltage to the address switches to obtain a flow of current through the individual ones of the address switches having the first state of operation and operative in the depowered state of the vehicle for preventing the application of the energizing voltage to the address switches, including the address switches in the first state, to prevent the flow of current through the address switches.

25. A combination as set forth in claim 24, including a plurality of impedances, and a plurality of circuit branches each including an individual one of the address switches and an individual one of the impedances.

26. In a combination as set forth in claim 24, an additional switch connected to the address switches and having first and second states of operation and operative in the first state in the powered state of the vehicle to provide for the flow of current through the individual ones of the address switches in the first state and operative in the depowered state of the vehicle to prevent the flow of current through the address switches including the address switches in the first state.

27. In combination, a vehicle having a powered state at first times and having a depowered state at second times different from the first times, a plurality of address switches in the vehicle, the address switches having first and second states of operation, a battery disposed in the vehicle and constructed to provide an energizing voltage, and first means responsive to the energizing voltage from the battery and disposed in circuit branches with the battery and the address switches for providing for a flow of current, in the powered state of the vehicle, through individual ones of the address switches in the first state of operation of the address switches and for preventing the flow of current through the address switches, including the address switches in the first state of operation, in the depowered state of the vehicle.

28. In a combination as set forth in claim 27, a plurality of impedances, and each of the circuit branches including an individual one of the address switches and an individual one of the impedances.

29. In a combination as set forth in claim 27, the first state in each of the address switches being a closed state, the first means including a microprocessor responsive to the operation of the vehicle in the powered state for providing for the flow of current through the circuit branches with the closed address switches and responsive to the operation of the vehicle in the depowered state for preventing the flow of current through the circuit branches including the circuit branches with the closed address switches.

30. In a combination as set forth in claim 27, the first means including a microprocessor operative to determine, in accordance with the addressing or failure to address the vehicle, when the vehicle is in the powered state and when the vehicle is in the depowered state, the microprocessor being responsive to the operation of the vehicle in the powered state for providing for the flow of current through the circuit branches with the address switches in the first state and being responsive to the vehicle in the depowered state for preventing the flow of current through the circuit branches including the circuit branches with the address switches in the first state.

31. In a combination as set forth in claim 27, the first means including an additional switch having first and second states of operation and operative in the first state to provide for the flow of current through the circuit branches with the address switches in the first state and operative in the second state to prevent the flow of current through the circuit branches including the circuit branches with the address switches in the first state and the first means including a microprocessor operatively coupled to the additional switch to provide for the operation of the additional switch, in the powered state of the vehicle, in the first state, and to provide for the operation of the additional switch, in the depowered state of the vehicle, in the second state.

32. In a combination as set forth in claim 27, the first means including a microprocessor operative to provide a first voltage to the address switches in the powered state of the vehicle and to provide a second voltage to the address switches in the depowered state of the vehicle, the first voltage being operative to provide a flow of current through the circuit branches having the address switches in the first state and the second voltage being operative to prevent a flow of current through the circuit branches including the circuit branches with the address switches in the second state.

33. In combination for use in a vehicle having powered and depowered states, a source of direct voltage, a plurality of impedances, a plurality of address switches each having first and second states of operation, individual ones of the address switches being operable in the first state and the other ones of the address switches being operable in the second state to provide an address for the vehicle, a plurality of circuit branches each including an individual one of the impedances and an individual one of the address switches, an additional switch having first and second states of operation, the additional switch being connected in a plurality of circuits each including the source of direct voltage and the additional switch and an individual one of the circuit branches, and a microprocessor operatively coupled to the additional switch to provide the first state of operation of the additional switch in the powered state of the vehicle and to provide for an addressing of the vehicle in accordance with the operation of the individual ones of the address switches in the first state and to provide the second state of operation in the additional switch in the depowered state of the vehicle.

34. In a combination as set forth in claim 33 wherein the impedances are resistances and wherein each of the circuit branches has a terminal connected to receive a reference potential.

35. In a combination as set forth in claim 33 wherein each of the circuit branches includes the individual one of the impedances in series with the individual one of the address switches and wherein each of the circuits includes the source of direct voltage, the additional switch and the individual one of the circuit branches.

36. In a combination as set forth in claim 35 wherein the impedances are resistances and wherein each of the circuit branches has a terminal connected to receive a reference potential.

37. In combination, a vehicle having powered and depowered states, a plurality of address switches in the vehicle, each of the address switches having first and second states of operation, individual ones of the address switches being operable in the first state, and the other ones of the address switches being operable in the second state, to provide an address for the vehicle, a source of direct voltage in the vehicle, a plurality of impedances in the vehicle, a plurality of circuit branches in the vehicle, each of the circuit branches including an individual one of the impedances and an individual one of the address switches, an additional switch in the vehicle, the additional switch having first and second states of operation, the additional switch being connected in the vehicle in a plurality of circuits each including the source of direct voltage and the additional switch and an individual one of the circuit branches, and a microprocessor in the vehicle, the microprocessor being operatively coupled to the additional switch to provide the first state of operation of the additional switch in the powered state of the vehicle and an addressing of the vehicle in accordance with the operation of the individual ones of the switches in the first state and to provide the second state of operation of the additional switch in the depowered state of the vehicle, the vehicle being constructed to provide operations when addressed, and a receiving element in the vehicle for receiving packets of signals including first signals for addressing the vehicle and second signals for providing for operations of the addressed vehicle.

38. In a combination as set forth in claim 37 wherein the impedances are resistances and wherein each of the circuit branches has a terminal connected to receive a reference potential.

39. In a combination as set forth in claim 37 wherein each of the circuit branches includes the individual one of the impedances in series with the individual one of the address switches and wherein each of the circuits includes the source of direct voltage, the additional switch and an individual one of the circuit branches.

40. In a combination as set forth in claim 39 wherein the impedances are resistances and wherein each of the circuit branches has a terminal connected to receive a reference potential.

41. In a combination as set forth in claim 37 wherein the vehicle is a toy vehicle and wherein structures are included in the toy vehicle for operating the toy vehicle in accordance with the second signals in the packets of signals addressed to the toy vehicle.

42. In combination for use in a vehicle having powered and depowered states, a source of direct voltage, a plurality of impedances, a plurality of address switches each having first and second states of operation, individual ones of the address switches being operable in the first state, and the other ones of the address switches being operable in the second state, to provide an address for the vehicle, a plurality of circuit branches each including an individual one of the impedances and an individual one of the address switches, and a microprocessor for providing a first voltage in the powered state of the vehicle and a second voltage in the depowered state of the vehicle, the microprocessor being connected to the address switches to prevent a current from passing through the circuit branches, including the circuit branches with the address switches in the first state, in the depowered state of the vehicle and to provide, in the powered state of the vehicle, for the flow of currents through the circuit branches with the address switches in the first state.

43. In a combination as set forth in claim 42, each of the address switches having first and second terminals, the individual one of the impedances in each of the circuit branches having a first terminal connected to the source of the direct voltage and having a second terminal connected to the first terminal in the individual one of the address switches in the circuit branch and the second terminal in the address switches being connected to the microprocessor.

44. In a combination as set forth in claim 43, a plurality of lines each having first and second ends and each connected at the first end to the microprocessor and each connected at the second end to the first terminal in an individual one of the address switches.

45. In a combination as set forth in claim 44 wherein the impedances are resistors and the source of the direct voltage is a battery.

46. In a combination as set forth in claim 42 wherein the individual one of the impedances, and the individual one of the address switches, in each circuit branch are connected to provide for the introduction of the first voltage from the microprocessor to the individual one of the address switches, and to provide for the flow of current from the source of direct voltage through the individual one of the impedances, when the individual one of the address switches has the first voltage and to provide for the introduction of the second voltage from the microprocessor to the individual one of the address switches thereby to prevent the flow of current from the source of direct voltage through the individual one of the impedances.

47. In combination, a vehicle having powered and depowered states, a plurality of address switches in the vehicle, each of the address switches having first and second states of operation, individual ones of the address switches being operable in the first state, and the other ones of the address switches being operable in the second state, to provide an address for the vehicle, a source of direct voltage in the vehicle, a plurality of impedances in the vehicle, a plurality of circuit branches in the vehicle, each of the circuit branches including an individual one of the impedances and an individual one of the address switches, and a microprocessor in the vehicle, the microprocessor being operatively coupled to the address switches to provide a first voltage on the address switches in the powered state of the vehicle and to provide a second voltage on the address switches in the depowered state of the vehicle, the first voltage having a magnitude relative to the magnitude of the direct voltage from the source to provide for a flow of current through the individual ones of the impedances in which the associated ones of the address switches have the first state of operation and the second voltage having a magnitude relative to the direct voltage from the source to prevent current from flowing from the source of direct voltage through the impedances, the vehicle being constructed to provide operations when addressed, and a receiving element in the vehicle for receiving packets of signals including first signals for addressing the vehicle and second signals for providing for operations of the addressed vehicle.

48. In a combination as set forth in claim 47 wherein the vehicle is a toy vehicle and wherein structures are included in the toy vehicle for operating the toy vehicle in accordance with the second signals in the packets of signals addressed to the vehicle.

49. In a combination as set forth in claim 47 wherein the impedances are resistances and the source of direct voltage is a battery.

50. In a combination as set forth in claim 47, each of the address switches having first and second terminals, the individual one of the impedances in each of the circuit branches having a first terminal connected to the source of the direct voltage and having a second terminal connected to the first terminal in the individual one of the address switches in the circuit branch and the second terminal in the address switches being connected to the microprocessor.

51. In a combination as set forth in claim 47, a plurality of lines each having first and second ends and each connected at the first end to the microprocessor and each connected at the second end to the first terminal in an individual one of the address switches.

52. In a combination as set forth in claim 47 wherein the individual one of the impedances, and the individual one of the address switches, in each circuit branch are connected to provide for the introduction of the first voltage from the microprocessor to the individual one of the address switches, and to provide for the flow of current from the source of direct voltage through the individual one of the impedances, when the individual one of the address switches has the first voltage and to provide for the introduction of the second voltage from the microprocessor to the individual one of the address switches thereby to prevent the flow of current from the source of direct voltage through the individual one of the impedances.

* * * * *

UNITED STATES PATENT AND TRADEMARK OFFICE

CERTIFICATE OF CORRECTION

PATENT NO. : 6,139,398
DATED : October 31, 2000
INVENTOR(S) : Peter C. DeAngelis It is certified that error appears in the above-identified patent and that said Letters Patent is hereby corrected as shown below:

Title page,
After item [76] "Inventor...", add new item [73] -- Assignee: ROKENBOK TOY CO., Cardiff, CA (USA) --.

Column 8, claim 16,
Line 50, after "with the", add -- vehicle in the --.

Signed and Sealed this

Sixth Day of November, 2001

*Attest:*

Nicholas P. Godici

NICHOLAS P. GODICI
*Acting Director of the United States Patent and Trademark Office*

*Attesting Officer*